US005405723A

United States Patent [19]

Rhodes et al.

[11] Patent Number: 5,405,723

[45] Date of Patent: Apr. 11, 1995

[54] XEROGRAPHIC PRESS CAPABLE OF SIMULTANEOUS MASTER MAKING AND PRINTING

[75] Inventors: Warren Rhodes, Boulder, Colo.; Gerhard Nothmann, Pasadena, Calif.

[73] Assignee: Xerox Corporation, Stamford, Conn.

[21] Appl. No.: 983,922

[22] Filed: Dec. 1, 1992

[51] Int. Cl.[6] ..... G03G 13/28

[52] U.S. Cl. ..... 430/49; 430/126; 118/648; 355/327

[58] Field of Search ..... 430/45, 49, 126; 118/648; 355/327, 326

[56] References Cited

U.S. PATENT DOCUMENTS 3,847,077 11/1974 Zirnstein et al. ..... 101/24
3,906,897 9/1975 Davidson ..... 118/637
3,940,272 2/1976 Davidson ..... 96/1.4
4,134,341 1/1979 Weigele et al. ..... 101/142
4,897,327 1/1990 Dubin et al. ..... 430/45
4,960,660 10/1990 Dubin et al. ..... 430/49

*Primary Examiner*—John Goodrow
*Attorney, Agent, or Firm*—Kenyon & Kenyon

[57] ABSTRACT

A printing apparatus comprises a reprographic device for producing at least one reprographic master representative of at least a portion of an image, and an image transfer device for transferring at least a portion of the image from at least one reprographic master to a sheet member to form an image on the sheet member, wherein the image transfer device is capable of simultaneous operation with the reprographic device. The apparatus, which utilizes standard printing press architecture, is capable of creating permanent masters, while simultaneously producing copies utilizing previously made masters.

12 Claims, 3 Drawing Sheets

XEROGRAPHIC PRESS CAPABLE OF SIMULTANEOUS MASTER MAKING AND PRINTING

BACKGROUND OF THE INVENTION

The invention relates generally to an electronic reprographic printing system, and more particularly concerns an apparatus capable of producing reprographic masters and for subsequent printing on copy sheets by employing previously produced masters in printing operations.

To date, the entry of electronic high quality, multicolor reprographic printing systems into the commercial printing market has been limited by factors relating to the quality of the image produced by these systems, the productivity of these systems and by the development and capital unit costs associated with this technology.

The commercial printing market has recently increasingly utilized computer technology, particularly in the field of color printing. However, this utilization has generally been limited to preparatory operations, such as text editing, composition, page make-up, plate or master making, and associated functions. The standard commercial printing processes themselves, principally letterpress offset lithography and gravure, are not readily computer compatible. Even the most advanced printing operations now available utilize computerized processes, based on digital technology, only up to the preparation of the film, or in some instances up to the preparation of the printing plates, masters, or cylinders. Beyond this stage in the process, these media are then used with traditional techniques and equipment to produce printed sheets.

This is, at least in part, due to the fact that computer compatible printing processes, such as electrophotography, ink-jet and thermography, cannot yet satisfy the normal image quality and productivity requirements of most segments of the commercial multicolor printing market. Thus, there is a need for an automated system capable of printing high quality images, at a sufficient rate, from information received either directly from a computer or scanned from existing images.

Recent developments have vastly improved the quality of the images produced by electronic reprographic systems. However, currently available systems have been unable to meet the productivity and reliability requirements of the commercial printing market.

There is thus a need for an electronic reprographic apparatus for rapidly and reliably producing multiple copies of high image quality.

The cost of equipment currently in use in the commercial printing market, letterpress, lithographic offset and gravure systems, is very high. The required capital investment cost has frequently been kept reasonably low by basing new equipment designs on modifications of existing devices. A prominent example of this is the offset press, early versions of which were developed through the conversion of older letterpress machines then in existence. A further factor is the retraining of skilled operators and service personnel. The cost of these is usually also reduced by introducing new technology by modification of existing designs.

Most standard sheet-fed offset press architectures are based on a sheet path low in the press structure and on feeding the imaging materials, i.e. ink and water, downward from above. In contrast, most electronic reprographic machines feature a high paper path, with the imaging material, i.e. toner, being fed upward from below. This basic structural difference is one major reason why electronic reprographic technology has not previously been combined with the mechanical structures available in lithographic offset and gravure systems.

Thus, there is a need for a reprographic printing apparatus of enhanced productivity which is capable of simultaneously printing and producing masters.

SUMMARY OF THE INVENTION

Many of the problems discussed above are overcome by the present invention. Particularly because of the expense associated with purchasing and erecting letterpress lithographic offset and gravure systems, the construction of printing systems totally independent of these existing systems can be prohibitive. The invention described herein provides electronic reprographic technology utilizing xerographic (also termed electrophotographic) techniques which can be adapted to existing offset printing apparatus. As a result, the marginal cost is relatively low for improving printing. With this approach, efficiencies in preparing masters for the purposes: of printing can be accomplished in an economical fashion while maintaining acceptable quality for the images being printed. The present invention thus takes advantage of the computer compatibility, automatic nature, low cost, and reliability of electrophotographic printing.

One embodiment of the invention is directed to a printing apparatus including a reprographic device for producing at least one permanent master representative of at least a portion of an image generated through digital computer means or scanned from an original. The apparatus also includes means for transferring that portion of an image represented on at least one permanent master to a copy sheet, in a predetermined alignment and position, to form an image on the sheet, while the reprographic device simultaneously prepares one or more new masters.

The invention is directed to a printing apparatus which receives a digital data stream representative of an image directly from any outside source, i.e. a computer, and which then prepares a permanent reprographic master, or set of masters, from that data stream.

The invention is directed to a printing apparatus employing a printing structure modified from the structure of currently available lithographic offset printing presses. This structure includes the feature standard to lithographic offset printers, but only recently available in reprographic systems, of applying the imaging materials from above, or nearly above, the sheet path. Through the use of such available printing press structures, the normally high development and unit costs for these machines are, therefore, reduced.

DETAILED DESCRIPTION

Figure 1:
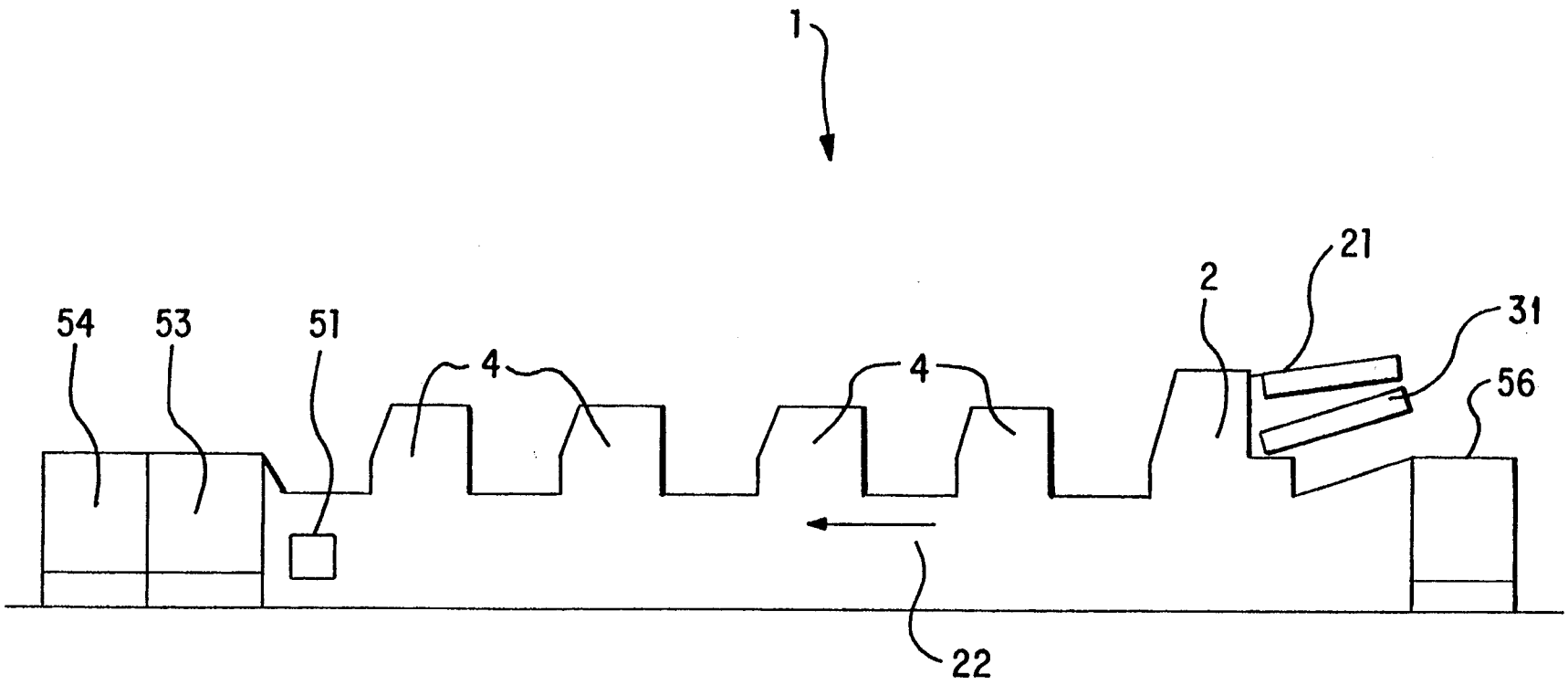
FIG. 1 shows an embodiment of a printing apparatus according to the present invention.

For a general understanding of the features of the present invention, reference is made to the drawings. In the drawings, like references have been used throughout to designate identical elements. It will become apparent that the present invention is equally well suited for use in a wide variety of printing systems and is not necessarily limited to those systems shown herein.

Figure 2:
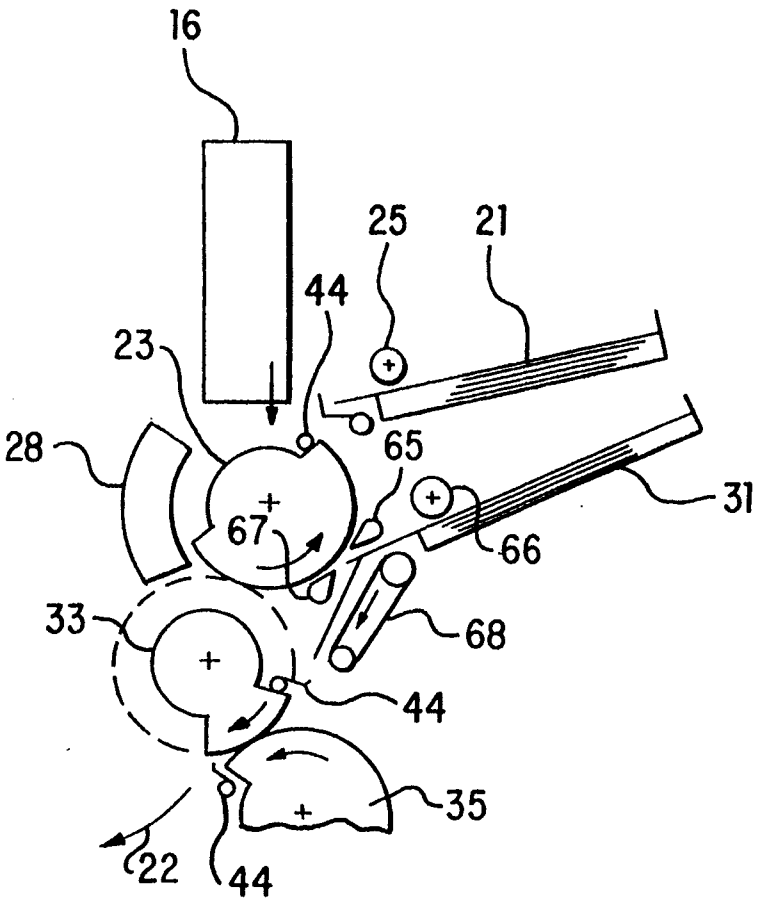
FIG. 2 shows a master making unit of a printing apparatus according to the present invention.
Figure 4:
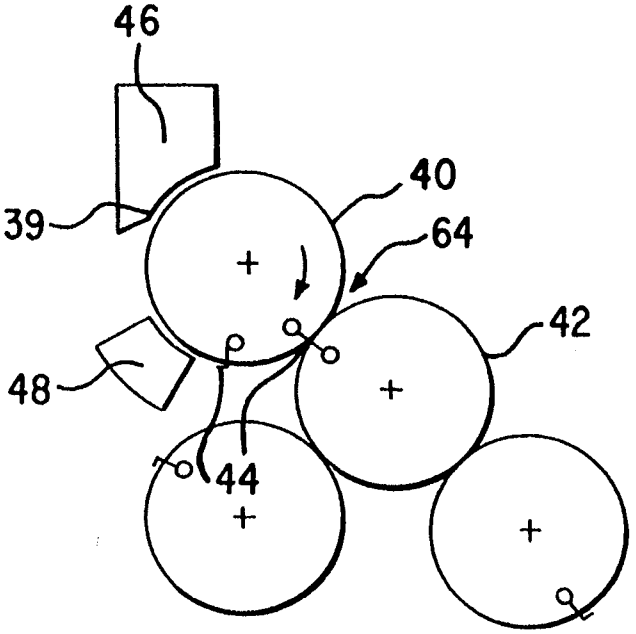
FIG. 4 shows the reprographic printing structure of a color printing unit according to the present invention.

Turning initially to FIGS. 1, 2, and 4, a reprographic printing apparatus according to the present invention is indicated generally by numeral 1. Apparatus 1 includes a master making unit 2, and four printing units 4.

Since four such printing units are commonly used for commercial color printing, these illustrations and this description are based on the use of such four units. It will be understood, however, that the number of such units may be 1, 2, 3, or numbers larger than 4. These units are referred to as color units but it will be understood that the term color also applies if the unit produces a black image, as is normally true for one of the units of such printing apparatus.

During operation of the printing system, an image data stream representing an image is fed by electronic means to the master making unit 2, as is well known in the art. An example of such feeding of an image data stream is the stream fed from a computer work station by cable to a laser printer such as the Hewlett-Packard Laserjet IIP. Unexposed photoconductive masters are fed, one at a time, from a feeder tray 21, to master making cylinder 23, via feed mechanism, 25 as is well known in the art. The master is held in position on the master making cylinder 23 by means of known gripper mechanisms 44. An example of such means for feeding and gripper holding of such masters is the Total Copy System, sometimes referred to as Copymaker, manufactured by the Addressograph Multigraph Company of Mt. Prospect, Ill.

A Charge/Raster Output Scanner (ROS) 16, which may include a laser and an associated rotating polygon mirror assembly as is known in the art, transfers the digital image data stream to the master in the form of small pixels arrayed in a series of horizontal scan lines with each line having a specified number of pixels per inch. As the master making cylinder 23 is continuously rotated counterclockwise at a speed which is compatible with the process requirements of master making, successive line elements of a master held on the master making cylinder 23 are rotated counterclockwise past the Charge/ROS 16. Charge/ROS 16 charges the total surface of the master and then selectively exposes the master in accordance with the image data. This charging and exposing process is well known in the state of the art of electrophotography, as is also true for the subsequent steps in this process. An example of such a process and of the master material is disclosed in the Journal of Imaging Science, Vol. 32, No. 6, 1988, pp. 247–254, describing the use of a master called Xerox AMEN (Agglomeration Migration Electrophotographic Negative). It will be understood that optical imaging devices other than a laser scanner can also be used to expose the master for forming a latent image. Such other devices may include the general category of what is generally known in the industry as image bars.

Immediately following charge and exposure, master making cylinder 23 is further rotated counter-clockwise bringing each master adjacent a master processor 28. The masters are processed in the master processor 28 so as to produce a permanent latent image on each master which, because of its electrical resistivity, can hold a charge for subsequent development, while non-image areas are rendered permanently conductive so that they cannot hold such a charge. The image on each exposed master corresponds to the particular color component of the original. Each set of masters, therefore, forms a set of subtractive primary latent images which are suitable for printing in a multicolor process to be described in the following, and well known in the art.

During further counter-clockwise rotation of the master making cylinder 23, each master is ejected sequentially by known means, face down, onto master stand-by tray 31. Specifically, a stripper element 65 assures that each master is stripped from the master making cylinder 23 after rotation past the charge/ROS 16 and the master processor 28 and the masters are, subsequently, deposited into the master stand-by tray 31.

Master making cylinder 23 is driven by an electric servo-motor 47, which is independent of the operation of the power sources which drive the other elements of the printing apparatus. Specifically, the rotation of the master making cylinder 23 is at a speed of rotation appropriate for the master material. For the AMEN master material referenced earlier, this speed provides a linear velocity of the master of, for example, 6 inches per second.

Recorded on each master leaving the master making cylinder 23, is one of four latent images. For example, in a typical four color printing apparatus, one latent image, which corresponds to a particular color component of the image, is selected for development with cyan developer material. Another latent image is selected for development with magenta developer material and a third latent image is selected for development with yellow developer material. The fourth latent image is selected for development with black developer material. These latent images formed by Charge/ROS 16 on the masters correspond to the image signals received by the master making unit 2.

When a print run of copy sheets, using the masters in master stand-by tray 31, is ready to begin, i.e. either immediately after creation of the masters or after completion of the previous print run, to be described in the following, whichever occurs last, each of the next set of masters is fed into the sheet path via reciprocating transfer 33 and impression cylinder 35, in the direction of arrow 22. It should be understood that the term impression cylinder as directed to impression cylinder 35 of the master making unit is descriptive only of the structure of the cylinder and is not meant to suggest that printing takes place in the master making unit. Masters are fed out of the stand-by tray 31 via feed rollers 66, under guide element 67 and over belt transfer 68 onto reciprocating transfer 33. The reciprocating transfer 33 includes gripper mechanisms 44 which take the masters which are fed sequentially out of the stand-by tray 31 and which hold each master for conveyance by the reciprocating transfer 33 into contacting gripper mechanisms on the impression cylinder 35. The reciprocating transfer 33 then rotates clockwise past the location at which the gripper mechanisms of the reciprocating transfer 33 and the impression cylinder 35 interact, to a rest position where it does not interfere further with the movement of the master. As the impression cylinder, and the master gripped thereon, rotates counterclockwise, it draws each master sequentially into the sheet path and the master is conveyed to the appropriate printing unit 4. After the trailing edge of each master has moved onto the impression cylinder 35, the reciprocating transfer 33 returns to its extreme counterclockwise position to receive the subsequent master.

Power is transmitted from electric servo-motor 47 directly to the master making cylinder 23. Those skilled in the art will recognize that, through standard control of the gripper mechanisms 44 on master making cylinder 23, reciprocating transfer 33, and impression cylinder 35, each of these components may rotate freely past one another with no contact or interference between the sheet members being transported by the components.

A standard sheet path as is well known in the art is used in the printing mode to advance the sheets on which an image is to be reproduced from feeder pile 56 through each respective printing unit. An example of lithographic offset printing apparatus using such a sheet path is the GTO printing press manufactured by the Heidelberg Schnellpressenfabrik of Heidelberg, Germany. A portion of this sheet path is also used, in the master transmission mode to convey masters to their respective printing units 4. It is one of the essential features of the present invention that, in fact, the segment of the sheet path extending from the master making unit to the last of the printing units is used not only for conveying sheets to be printed, but also the masters, as appropriate. The term bias-transfer roll is used to describe the element of the multicolor reprographic printing press which performs a function corresponding to that of the impression cylinder of standard offset lithographic presses.

Once in the sheet path, each master is directed to a respective printing unit 4 through the sheet path in the direction of arrow 22 by means of known sheet feeding mechanisms. Each master is then transmitted to the master cylinder 40 in the appropriate printing unit 4 and is automatically clamped onto that cylinder by gripper means well known in the art.

During printing, the latent image on a master is charged and developed as described in the following with, (for example) either cyan, magenta, yellow or black developer material in the printing unit corresponding to the color appropriate for the master used in that unit. These developed images are transferred to copy sheets in superimposed registration with one another to form a multi-colored image on the copy sheets. This multi-colored image is then fused to the copy sheet, by a known fusing apparatus 51, forming a finished color copy. The printed sheet is then conveyed to and deposited in the sheet delivery 54.

With continued reference to FIGS. 1, 2, and 4, and as referenced previously the masters are preferably made from a photoconductive material which may be the Xerox AMEN material or zinc oxide coated papers or plastic material. Each master is moved via the sheet path in the direction of arrow 22 until the master has reached its respective printing unit 4. At this point, the master is then fed by known mechanisms to the master cylinder 40 of the respective printing unit 4. Known gripper mechanisms 44 and gripper control mechanisms maintain the master on the master cylinder 40 in a predetermined alignment.

In the printing mode of the apparatus, to be described in further detail next, after all masters have been conveyed to, and clamped at, the respective printing units and after a stream of copy sheets has been initiated via the feeder 56 and the sheet path, the following process occurs continuously: The electrophotographic image transfer, or printing, process to be described is well known and has been utilized, for example on the 6500 color copier manufactured by the Xerox Corporation.

The master, which is clamped onto the continuously rotating master cylinder 40, is first rotated to pass adjacent to charger 48. The master is then advanced to a development station indicated generally by the reference numeral 46 which applies toner of a particular color to the master. Continued clockwise rotation of the master cylinder 40 brings the master adjacent to the bias transfer roll 42 in a predetermined alignment with a copy sheet which has been transferred to bias transfer roll 42 from the sheet path and is maintained on bias transfer roll 42 in a predetermined alignment by known gripper mechanisms 44. The master and the copy sheet are then brought into contact with one another by further clockwise rotation of master cylinder 40 and bias transfer roll 42. As the master and the copy sheet move in contact with one another, the image on the master is transferred to the copy sheet in a predetermined alignment. In transfer zone 64, the toner image is transferred to the printed sheet material, such as plain paper or plastic. This transfer takes place in a transfer zone, generally indicated by reference numeral 64. The transfer occurs as a result of an appropriate charge placed on the bias transfer roll 42 by means well known in the art. Continued rotation of bias transfer roll 42 moves the master out of contact with the copy sheet which continues to move along the sheet path toward the next printing unit 4.

Figure 3:
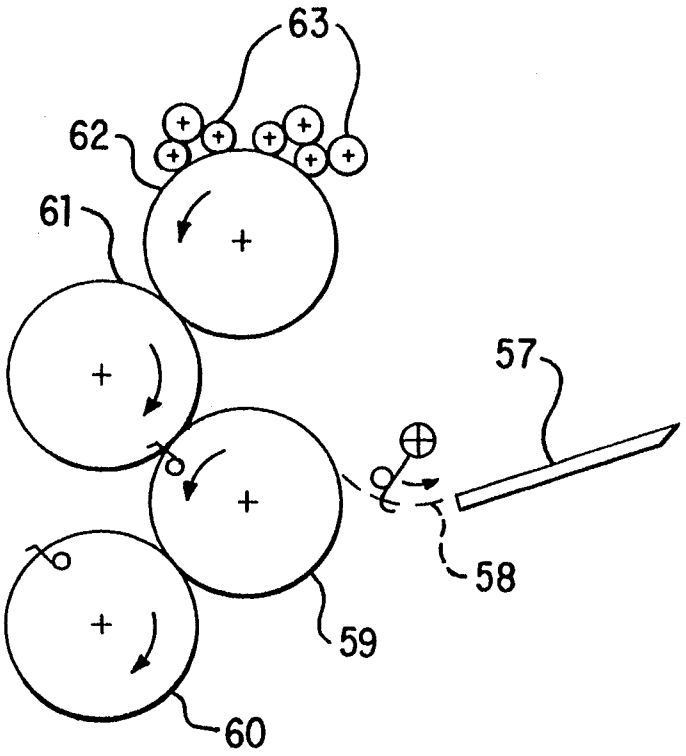
FIG. 3 shows a standard lithographic offset printing structure for a first printing unit.

The similarity of the structure of the master making unit 2 of the present invention and standard offset press architectures may be seen through a comparison of FIGS. 2 and 3. In a standard offset press, sheets are fed from a register table 57 to an impression cylinder 59. As impression cylinder 59, blanket cylinder 61 and plate cylinder 62 rotate in synchronism through appropriate gear means, ink and moisture system 63 causes ink to be transferred to the image area of a plate on plate cylinder 62 and the image on plate cylinder 62 is transferred to blanket cylinder 61. As the image on blanket cylinder 61 rotates into contact with the sheet on the impression cylinder 59, the image is transferred to the copy sheet.

As shown in FIG. 2, in the master making unit of the present invention, the plate and blanket cylinders are replaced by the single master making cylinder 40 of the present invention, with the addition of appropriate master feeder tray 21 and stand-by tray 31. In addition, the inkers 63 are missing and have been replaced by the corresponding reprographic elements for the production of masters, namely, Charge/ROS 16, and master processor 28. Other than these differences, the structure of the master making unit 2 is quite similar to that of the standard offset printing apparatus.

Figure 5:
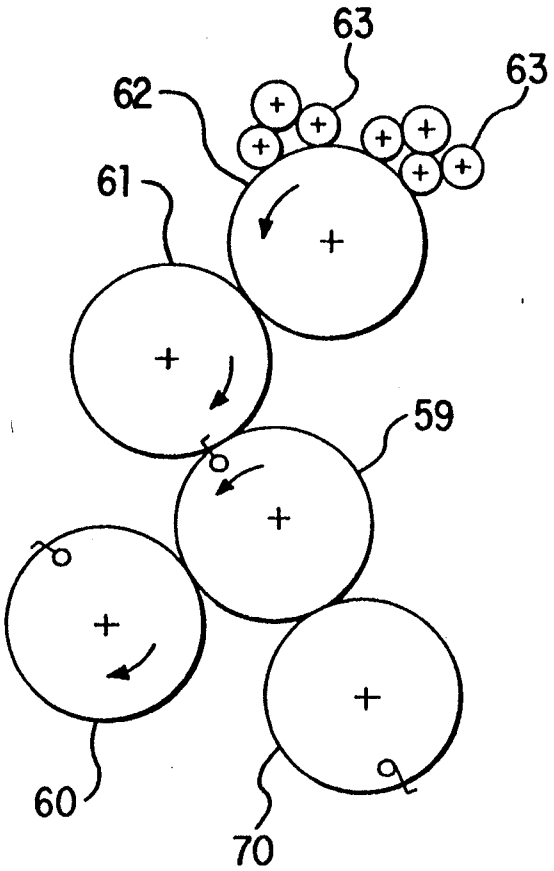
FIG. 5 shows a second standard lithographic offset printing structure for a subsequent printing unit.

The similarity of the structure of the printing units 4 of the present invention and standard offset press architectures may be seen through a comparison of FIGS. 5 and 4. In FIGS. 3 and 5, like reference numerals indicate like elements. FIG. 5 shows a standard lithographic offset press architecture for a subsequent printing unit of a standard lithographic press. The printing unit of FIG. 5 operates similarly to that of FIG. 3 except that, instead of receiving copy sheets from the register table, the printing unit of FIG. 5 receives such sheets from the transfer drum 70. It may be seen that the ink and moisture system 63 of the printing unit of FIG. 5 has been omitted in the printing unit of the present invention. The blanket cylinder 61 of this printing unit has been replaced, in the printing unit of the present invention, by the master cylinder 40, the impression cylinder has been replaced by the bias transfer roll 42, while the charging and development units 46 and 48, respectively, have been added. In addition, a cleaning unit (not shown) may be added if needed.

As seen in FIG. 4, in order to retain the basic configuration of a standard lithographic offset printer, a developer unit 46 is located nearly above the master cylinders. The developers of the present embodiment are of the type disclosed in U.S. Pat. Nos. 3,906,897 and 3,940,272, which are hereby expressly incorporated herein by reference as part of the present disclosure. This patent is practiced in the 6500 color copier manufactured by the Xerox Corporation and referenced previously. However, those skilled in the art will recognize that this embodiment of the present invention may be practiced with any developer which is capable of being operated from above the sheet path. Developer units 46 apply toner particles of a specific color which corresponds to the latent image recorded on the master.

Throughout its movement in the sheet path, the sheet is controlled by leading edge gripper mechanisms and, as appropriate, transferred from one set of gripper mechanisms to the next in an appropriate transfer zone, in a manner well known in the art.

After the last printing operation, the sheet is conveyed in the sheet path to a fusing station, indicated generally by the reference numeral 51 where the transferred toner image is permanently fused to the sheet. The fusing station may include a heated fuser roll and a pressure roll as is known in the art. Thereafter, the sheet is advanced through the sheet path to delivery 53 for subsequent removal therefrom by the machine operator.

When a print run has been completed, the masters are fed into the sheet path and are deposited in delivery 54 for subsequent removal by a user. These masters may be reused to print additional runs of the same image by simply placing the masters into the stand-by tray 31 and, subsequently, transmitting them to their respective printing units 4.

While the invention has been described with reference to specific embodiments, it will be apparent to those skilled in the art that many alternatives, modifications, and variations may be made. Accordingly, it is intended to embrace all such alternatives, modifications, and variations that may fall within the appended claims.

What is claimed is:

1. A printing apparatus comprising:

first means for producing a first electrographic master set comprising at least one electrographic master representative of at least a portion of an image; and an image transfer device for transferring at least a portion of the image from said at least one electrographic master to a sheet member to form an image on the sheet member, wherein the image transfer device is capable of simultaneous operation with the first means so that said transferring may occur while the first means produces a subsequent electrographic master set.

2. An apparatus according to claim 1, further comprising second means for transferring the sheet member to the image transfer device in a predetermined alignment.

3. An apparatus according to claim 1, further including a plurality of image transfer devices, each image transfer device transferring at least a portion of an image to a sheet member in a predetermined alignment.

4. An apparatus according to claim 3, wherein each electrographic master in said first electrographic master set represents a respective color portion of the image, and wherein each image transfer device transfers the portion of the image represented by a respective electrographic master to the sheet member in a predetermined superimposed alignment.

5. An apparatus according to claim 1, further comprising a means for supplying successive sheet members to the image transfer device.

6. A method for producing an image on a sheet member comprising the steps of:

producing a first electrographic master set comprising at least one electrographic master representative of at least a portion of the image; and transferring at least a portion of the image from said at least one electrographic master to a sheet member, wherein the step of transferring an image from said at least one electrographic master to a sheet member is capable of being performed simultaneously with the step of producing a subsequent electrographic master set.

7. A method according to claim 6, further comprising the steps of:

producing a plurality of electrographic masters, each representative of a portion of the image;

sequentially transferring the portion of the image represented on each electrographic master to the sheet member in a predetermined alignment on the sheet member.

8. A method according to claim 7, wherein each electrographic master represents a respective color portion of the image, and wherein each image transfer device transfers the portion of the image represented by a respective electrographic master to the sheet member in a predetermined superimposed alignment.

9. An apparatus according to claim 1 further comprising transfer means for conveying either electrographic master members or copy sheet members.

10. An apparatus according to claim 1 wherein said master producing means comprises a cylinder means for producing said masters and means for automatically feeding and ejecting electrographic master members respectively to and from said cylinder means at a rotational speed corresponding to the processing speed appropriate for the production of said electrographic masters.

11. An apparatus according to claim 1 further comprising a speed control means for simultaneously operating said master producing means and said image transfer device at differing rotational speeds.

12. An apparatus according to claim 1 wherein said electrographic master producing means comprises automatic conveying means for temporarily storing and subsequently transferring multiple of said electrographic masters corresponding to an image original.

* * * * *